US005378178A

United States Patent [19]

Haman

[11] Patent Number: 5,378,178

[45] Date of Patent: Jan. 3, 1995

[54] TILLER ARM AND STEERING BRACKET ASSEMBLY

[75] Inventor: David F. Haman, Waukegan, Ill.

[73] Assignee: Outboard Marine Corporation, Waukegan, Ill.

[21] Appl. No.: 78,137

[22] Filed: Jun. 15, 1993

[51] Int. Cl.[6] ..... B63H 25/00

[52] U.S. Cl. ..... 440/53; 440/63

[58] Field of Search ..... 440/49, 52, 53, 63; 74/480 B

[56] References Cited

U.S. PATENT DOCUMENTS

| | | | |
|---|---|---|---|
| 2,526,946 | 10/1950 | Hawkins | 440/53 |
| 2,603,981 | 7/1952 | Snyder . | |
| 3,955,438 | 5/1976 | Zakrzewski | 440/53 |
| 4,496,326 | 1/1985 | Boda . | |
| 5,046,974 | 9/1991 | Griffin, Jr. et al. | 440/63 |
| 5,145,427 | 9/1992 | Kawai et al. . | |
| 5,194,025 | 3/1993 | Blanchard et al. . | |

*Primary Examiner*—Stephen P. Avila
*Attorney, Agent, or Firm*—Greer, Burns & Crain, Ltd.

[57] ABSTRACT

A tiller arm and steering bracket assembly where the tiller arm is pivotally coupled to the steering bracket such that it can be selectively positioned in either a generally horizontal position or a generally vertical position. The tiller arm includes an underside having interference ribs that contact the steering bracket when the tiller arm is placed in the horizontal position. The interference ribs each have a retaining ledge that supports the tiller arm on the head portion of the steering bracket in an upright position substantially perpendicular to the steering bracket when it is placed in the vertical position. The steering bracket has integral crest formations which contact the retaining ledges to provide additional support to the tiller arm when it is placed in the vertical position. A bore formed through the steering bracket accepts a retaining pin that contacts the tiller arm at a point which prevents the tiller arm from unintentionally returning to the horizontal position. Additionally, the steering bracket may have a recess and a channel formed through the steering bracket for accepting and mounting thereto a starter switch and starter mechanism.

19 Claims, 3 Drawing Sheets

TILLER ARM AND STEERING BRACKET ASSEMBLY

This invention relates generally to a tiller arm and steering bracket assembly for outboard motors, and more particularly to such an assembly which permits the tiller arm to be converted from a manual to a remote steering system and which provides a convenient mounting location for the start switch of the motor.

BACKGROUND OF THE INVENTION

Today's user of outboard marine motors demands versatility and convenience without sacrificing ease of use and durability of the motor and its components. Consequently, outboard marine motors are commonly designed to be converted from manual steering to remote steering and vice versa. Remote steering is generally desirable when the watercraft is utilized in such water sports as water skiing, large pontoon boats, and the like. Manual steering is typically desirable for fishing, or simply for use in boats not adapted with remote steering. However, on currently available motors, such a conversion often requires the removal of the tiller handle, and the addition of brackets or other mounting assemblies to provide for the remote steering.

It may also be desirable, and less expensive, to be able to use the same motor on different types of boats. For instance, the owner of an outboard motor may want to use the same motor on a typical fishing boat without remote steering and then dismount the motor and remount it on a pontoon boat or other boat having remote steering capabilities. Again, such adaptability, although feasible with currently available outboard motors, is often difficult and time consuming.

Further, currently available outboard motors may include start switch buttons which are located in areas that cause them to be damaged, that obstruct the operation of other devices on the motors or are inconveniently located. Also, current steering bracket designs do not protect the electrical wiring of the starter switch running to the motor assembly. Instead, the wiring is exposed where it can become tangled, worn and eventually damaged.

Accordingly, an object of the present invention is to provide an uncomplicated tiller arm and steering bracket assembly that allows the tiller arm to be moved to an upright position without removing or breaking the arm so that a remote steering mechanism can be attached to the steering bracket.

Another object of the present invention is to provide a tiller arm that can be pivoted up into and locked in an upright position during nonuse of the manual steering mechanism.

Yet another object of the present invention is to provide a steering bracket that provides for the mounting of a starter switch mechanism on the steering bracket in a manner which protects the starter switch mechanism and its wiring from damage.

Still another object of the invention is to provide a shift handle and start button assembly wherein the start button may be adjusted relative to the shift handle to ensure that the engine may be started only in the neutral gear position. This adjustment may be made without requiring the adjustment of the shift linkage, as is required on many conventional outboard motors.

SUMMARY OF THE INVENTION

In accordance with the present invention, all of these objects, as well as others not herein specifically identified are achieved generally by the present invention where a steering bracket is provided with a head portion having an outwardly projecting tongue. The tongue has a throughbore configured to accept and retain a remote steering mechanism. A tiller arm is pivotally coupled to the steering bracket such that it can be selectively positioned in either a generally horizontal position (the operative position) or a generally vertical position (the inoperative position).

The tiller arm also includes an underside having at least one interference rib depending therefrom where the interference rib(s) is(are) configured and arranged to contact the tongue when the tiller arm is placed in the operative position. The interference rib(s) has (have) at least one retaining ledge that supports the tiller arm on the head portion in an upright position substantially perpendicular to the steering bracket when the tiller arm is placed in the inoperative position. Further, the head portion includes at least one integral crest formation which contacts the retaining ledge (s) to provide additional support to the tiller arm when it is placed in the inoperative position. A bore may also be formed through the steering bracket proximate the head portion so that a retaining pin or other object may be introduced into the bore. The position and configuration of the retaining pin is such that it contacts the tiller arm at a point which prevents the tiller arm from unintentionally returning to an operative position.

Additionally, the steering bracket may have a recess and a channel formed through the steering bracket for accepting and mounting thereto a starter switch and starter mechanism. The recess and said channel are in direct communication and are designed to protect the starter switch and mechanism from accidental breakage and interference with the operation of the or tiller arm.

The ability to move the tiller arm into an upright or vertical position relative to the steering bracket not only adds to the versatility of an outboard motor, but also is beneficial in reducing the cost of shipping the motors and facilitating their storage.

In another embodiment, a shift handle and start button assembly is provided, which includes a shift handle body portion having an attachment formation accommodating and selectively positioning a start button bracket with respect to the body portion as well as the starter mechanism on the steering bracket. The start button bracket has a starter actuator portion configured to be operationally coupled to the starter mechanism when the body portion is attached to the steering bracket and the shift handle is in the neutral gear position. The start button mechanism is pivotally adjustable relative to the body portion.

BRIEF DESCRIPTION OF THE DRAWINGS

Further objects of the invention, together with additional features contributing thereto and advantages occurring therefrom, will be apparent from the following description of the preferred embodiment of the invention when read in conjunction with the accompanying drawings, wherein.

DETAILED DESCRIPTION OF THE PREFERRED EMBODIMENT

Figures 1, 3, 4, 5:
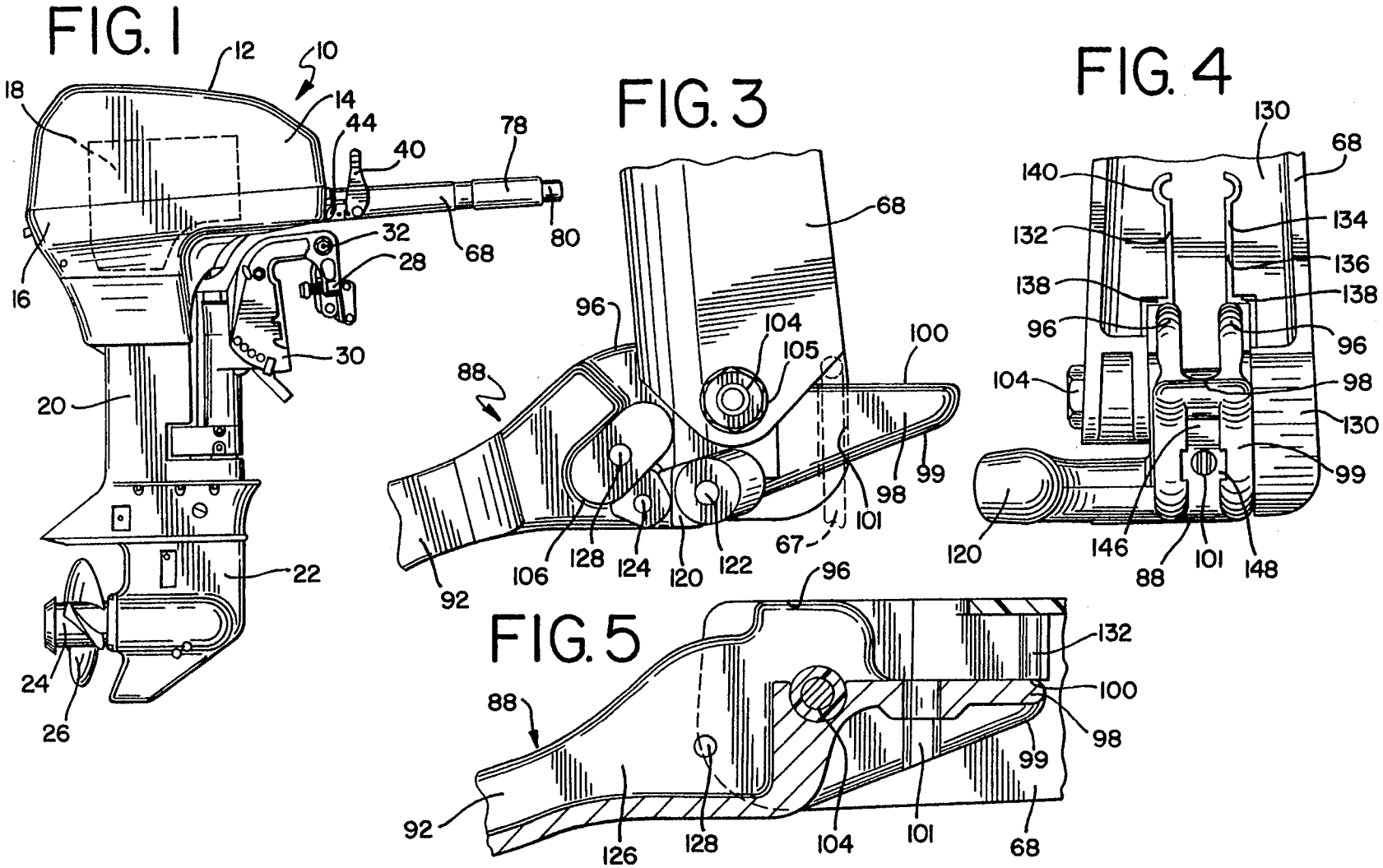
FIG. 1 is a side elevational view of an outboard motor of the type suitable for use with the present invention.
FIG. 3 is a starboard side view of the present tiller arm and steering bracket assembly showing the tiller arm in the upright position and showing the starter switch recess.
FIG. 4 is a frontal view of the tiller arm and steering bracket assembly FIG. 3 showing the tiller arm in the upright position.
FIG. 5 is a port side view of the tiller arm and steering bracket assembly showing the tiller arm in a downward or operational position.

Referring now particularly to FIG. 1, an outboard motor, designated generally at 10, is provided with an upper housing 12 including an upper motor cover 14 and a lower motor cover 16, which combine to enclose an engine 18 (shown hidden). Below the upper housing 12, an exhaust housing 20 has passageways (not shown) for accommodating the engine drive shaft, the engine exhaust, and the connection of the drive shaft to the transmission, the later component being enclosed by the gear case 22. A propeller shaft 24 equipped with a propeller 26 projects rearwardly from the gear case 22.

The motor 10 has a transom bracket 28 for mounting the motor to the transom of a boat hull (not shown). A swivel attachment assembly 30 is mounted to the transom bracket 28 by a horizontally disposed pivot pin 32. The pivot pin 32 passes through openings (not shown) formed through the swivel attachment assembly 30 and provides a pivot access which permits the tilting of the lower end of the motor 10 out of the water when not in use.

Figure 2:
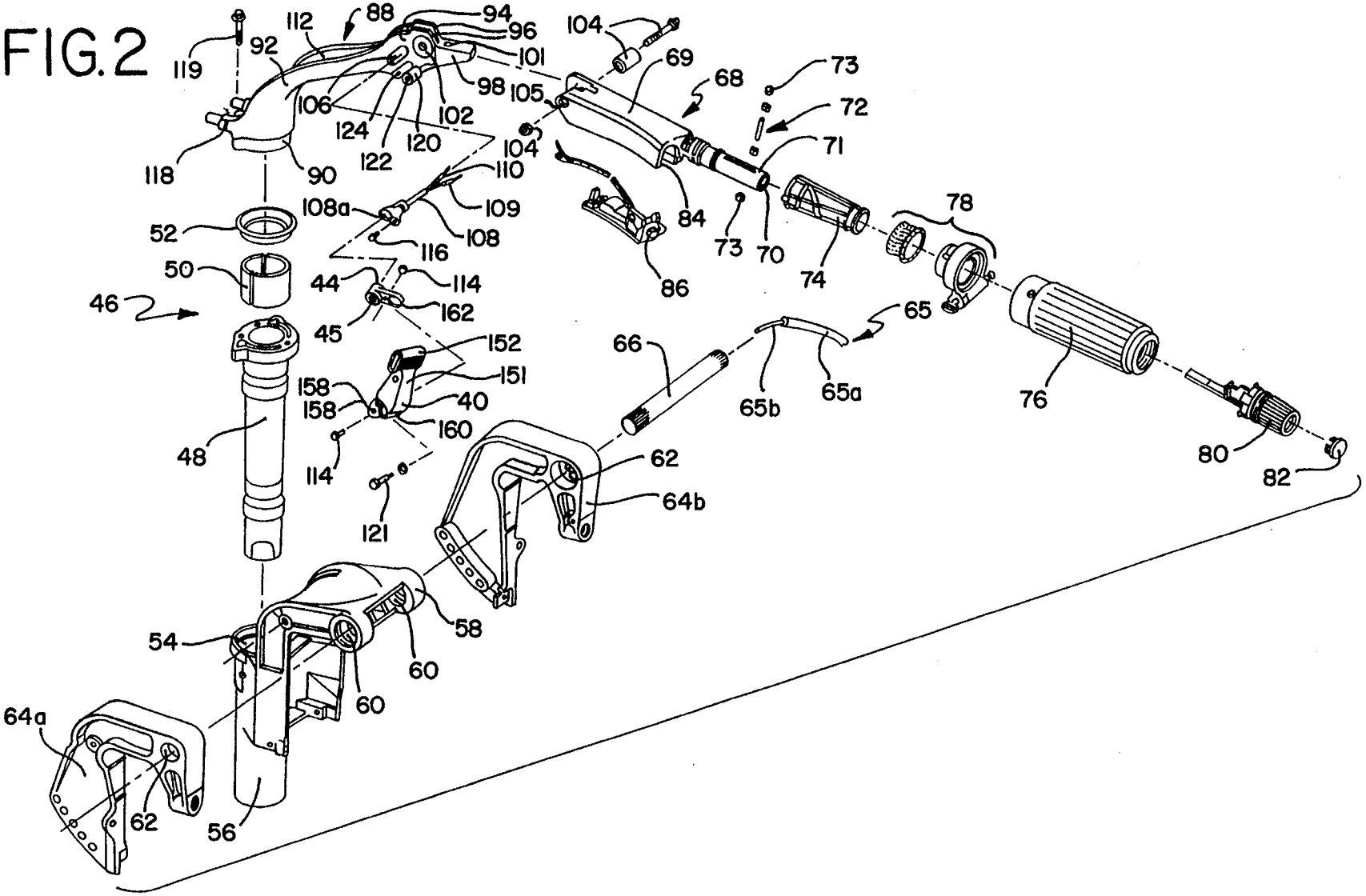
FIG. 2 is an exploded perspective view of the present tiller arm and steering bracket assembly of the motor of FIG. 1.

Also shown in FIG. 1, and referred to more specifically in the description of FIG. 2, is a tiller arm, also known as steering and throttle handle assembly 68. The shift handle 40 is used to place the motor into the appropriate gear, such as forward, neutral, or reverse. Shown for matters of clarity in FIG. 1 are the optional automatic starter switch button 44, the throttle grip 78, and the idle adjustment assembly 80.

Referring now to FIG. 2, the numerous components which comprise the midsection and steering and tiller arm portions of the motor 10 are shown in an exploded format. These components are the focus of the present invention. A friction block assembly is provided and includes a generally cylindrical pivot shaft 48, a protective liner 50, and a bushing 52. The friction block assembly 46, particularly the pivot shaft 48, is configured to mate with a channel 54 of the swivel bracket 56 and provide pivotal displacement of the motor 10, the exhaust housing 20, and the gear case 22 relative to the swivel attachment assembly 30 to steer the boat when the tiller arm 36 is pivotally or latitudinally moved by the user. The swivel bracket 56 includes an integral swivel bracket mounting structure 58 which itself has swivel bracket bores 60 that are configured to coincide or axially align with the mounting bores 62 that are formed through the starboard side stern bracket 64*a* and the port side stern bracket 64*b*. The swivel bracket 56 is mounted on a tilt tube (not shown) running between the starboard side stern bracket 64*a*, and port side stern bracket 64*b*, which once fastened together, constitute the swivel attachment assembly previously designated as 30. When automatic steering is desired, a steering cable 65 is fed through a hollow tilt tube 66, which is inserted into the swivel bracket bores 60. A sheath 65*a* of the cable 65 is attached to the tube 66, and the inner cable portion 65*b* is connected at one end (not shown) to a drag link 67 (shown in phantom in FIG. 3) which is also connected to the steering bracket.

In FIG. 2 there is also shown the steering and throttle handle assembly or tiller arm 68 having an elongated generally rectangularly shaped central body portion 69. A throttle mounting shaft 70 extending generally axially from the central body portion 69 includes a guide pin channel 71 which is configured to accept a guide pin assembly 72 that includes cylindrically shaped rollers 73. Together, the rollers 73 with the throttle mounting shaft 70 are configured to accept the helix twist sleeve 74. The helix twist sleeve 74 is axially movable around the circumference of the throttle mounting shaft 70 which, through a Bowden cable (not shown) communicates to the engine 18 the user's signal to accelerate or decelerate the motor 10 through the steering handle 68. A throttle twist grip 76 may be provided and can include a throttle friction assembly 78. An idle adjustment assembly 80, having an idle adjustment plug 82, may be included to provide for the adjustment of the idling speed of the engine 18. The idle adjustment assembly 80 may be disposed at the outermost end of the throttle twist grip 76 and extends through the throttle friction assembly 78, the helix twist sleeve 74 and the tiller arm 68 to communicate with the motor 10. The tiller arm 68 may also include a channel 84 which is configured for accepting a stop switch assembly 86.

Referring to FIGS. 2 and 3, the central mounting or steering bracket 88, bearing the likeness of a duck or goose-shaped head and neck portion, is provided with a lower shoulder 90, a central neck portion 92 and a head portion 94. The head portion 94 includes a ribbed crown 96 which is essentially two ribs being in spaced parallel relationship to each other. A tongue portion 98 extends from the head portion 94 and includes a lower surface 99 and an upper surface 100. A throughbore 101 extends through the lower surface 99 and upper surface 100 of the tongue portion 98 and is configured for the attachment of a remote steering mechanism (not shown).

A tiller arm attachment bore 102 is configured to receive a fastening assembly 104 to pivotally connect the tiller arm 68 through bore 105 in the arm 68 to the head 94 of the steering bracket 88. An inclined, oval recess 106 is provided for accepting and retaining a start switch mechanism 108 wherein the electrical leads 109 and 110 of the starter switch mechanism 108 are carried to the engine 18 within an open channel 112 formed through the central neck portion 92 of the steering bracket 88. A fastener 114, such as a threaded bolt and nut, is used to removably secure the start button bracket 44 to the shift handle 40 which in turn is secured to the steering bracket 88. The start button bracket 44 may be provided with a spring actuated button 45 that is positioned to be operationally coupled to the starter switch mechanism 108.

As will be described in further detail below, a feature of the present tiller arm and steering assembly is that the start button bracket 44 is pivotally adjustable relative to the shift handle 40.

The steering bracket 88 also includes a coupling feature 118 located along the lower shoulder portion 90 for securely attaching the steering bracket 88 to the pivot shaft 48 with a conventional fastener 119. The connection of the steering bracket 88 to the pivot shaft 48 is designed so that pivotal movement of the steering handle 68 about a vertical axis causes a similar pivotal displacement of engine 18, the exhaust housing 20 and the gear case 22 relative to the swivel attachment assembly 30 to steer the boat. The steering bracket 88 also includes an integrally formed outwardly extending boss 120 having a bore 122 configured for removably securing the shift handle 40 (FIG. 1) with a given fastener 121. The boss 120 of the steering bracket 88 also includes a bore 124 which accepts a fastener 116 for removably securing the starter switch mechanism 108 to the steering bracket 88.

Accordingly, the user can easily access all the functions necessary for the proper operation of the engine 18, such as the throttle, idle speed, emergency stop, or start switch easily, since they are all secured to and accessible from steering bracket 88 and the tiller arm 68.

Figure 6:
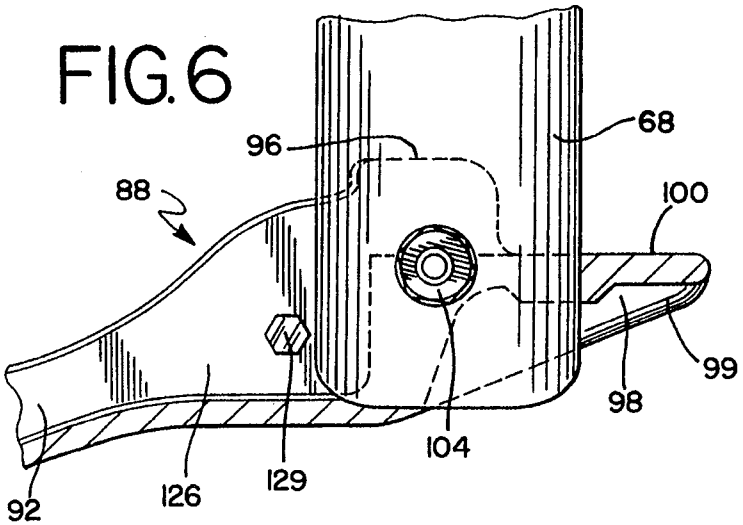
FIG. 6 is port side view of the tiller arm and steering assembly shown with the tiller arm locked in the upright position.

Turning now to FIGS. 3 and 6, the steering bracket 88 is depicted in a closeup view wherein it is shown that through the port side 126 a bore 128 extends through to the recess 106. The bore 128 is configured to accept a fastener 129 (shown in FIG. 6) which is installed into the bore 128 to retain the tiller arm 68 in the upright position when so desired.

The underside 130 of the central body portion 69 of the tiller arm 68, best seen in FIG. 4, is configured with at least one interference rib 132, and preferably including a second rib 134, which may be integrally formed with the underside 130 of the central body portion 69. The interference ribs 132 and 134 can be formed in numerous configurations, but it is preferred that they at least have a generally elongated central support segment 136 and that they form retaining ledges 138 at one end, closest to the steering bracket 88.

The interference ribs 132 and 134 can also include, as shown, an enlarged semicircular second end 140 at the end opposite the ledges 138. These second ends 140 are not required, but strengthen the ribs 132, 134 when the tiller arm 68 is being utilized for manual steering and is placed in a generally horizontal position against the upper surface 100 of the tongue 98 (FIG. 5).

The underside 99 of the tongue 98 is shown in FIG. 4 as having a channel 146 including a hex nut pocket 148 which is configured to accept a hex nut fastener (not shown) for the attachment of a remote steering mechanism (not shown) when the arm 68 is in the upright position and not in use.

Referring now particularly to FIGS. 3 and 6, there it is shown that the tiller arm 68 has been placed in a vertical or upright position so that a remote steering mechanism (not shown) can be secured to the steering bracket using the throughbore 101 formed in the tongue 98. As shown, the present invention allows the tiller arm 68 to remain attached to the steering bracket 88 while it is in a vertical position and out of interference with the tongue 98, the throughbore 101, as well as any remote steering mechanism which would be attached thereto. Accordingly, unlike currently available tiller arm and steering bracket assemblies, the present invention allows the user to retain the tiller arm 68 on the steering bracket 88 even when a remote steering mechanism is utilized.

Referring now to FIG. 4, there is shown a front view of the present steering bracket 88 where the tiller arm 68 has been pivoted into the upright position while still being connected to the steering bracket 88. It is evident that the retaining ledges 138, perform two functions. One function is to that of a contact spacer between the tiller arm 68 and the tongue 98 (FIG. 5). A second function of the retaining ledges 138 of the interference ribs 132 and 134, is to provide support for the tiller arm 68 upon the crest formations 96 the head portion 94 when the handle 68 is in the vertical position. Because the retaining ledges 138 are configured to correspond with the crests 96, the weight of the tiller arm 68 rests firmly upon the steering bracket 88. Further, the ledges 138 and corresponding crests 96, together with the fastener 129 (as shown in FIG. 6), act to firmly retain the tiller arm 68 in the upright and unused position.

Referring now to FIG. 5, the retaining fastener 129 has been removed from the bore 128 and the tiller arm 68 has been allowed to return to a horizontal or resting position upon the steering bracket 88. In accordance with the above-described preferred embodiment, it is shown in FIG. 5 that the central support segments 136 of the interference ribs 132 and 134 contact against the upper surface 100 of the tongue 98 to support and retain the tiller arm 68 in the horizontal position when the user of the watercraft utilizes the manual steering capabilities of the present invention. The semicircular ends 140 of the ribs 132 and 134 provide additional support for the tiller arm 68 upon the upper surface 100 of the tongue 98.

Referring now to FIG. 6, the tiller arm 68 is shown in the vertical or upright position to allow the user to convert from manual to remote steering. In this view, it is more clearly shown how the retaining fastener 129 acts to prevent the tiller arm 68 from pivoting back down towards the tongue 98 due to gravity or other factors. The retaining fastener 129 will make contact with the tiller arm 68 to lock the tiller arm 68 in the vertical or upright position. Once it is decided to convert back to manual steering, the user simply removes the retaining fastener 129 from the bore 128 and allows the tiller arm 68 to pivot downwards against and rest upon the upper surface 100 of the tongue 98. Of course, as shown in FIG. 5 and as explained above, the interference ribs 132 and 134 will allow the tiller arm 68 to firmly rest in the appropriately horizontal position upon the upper surface 100 of the tongue 98.

Figure 7:
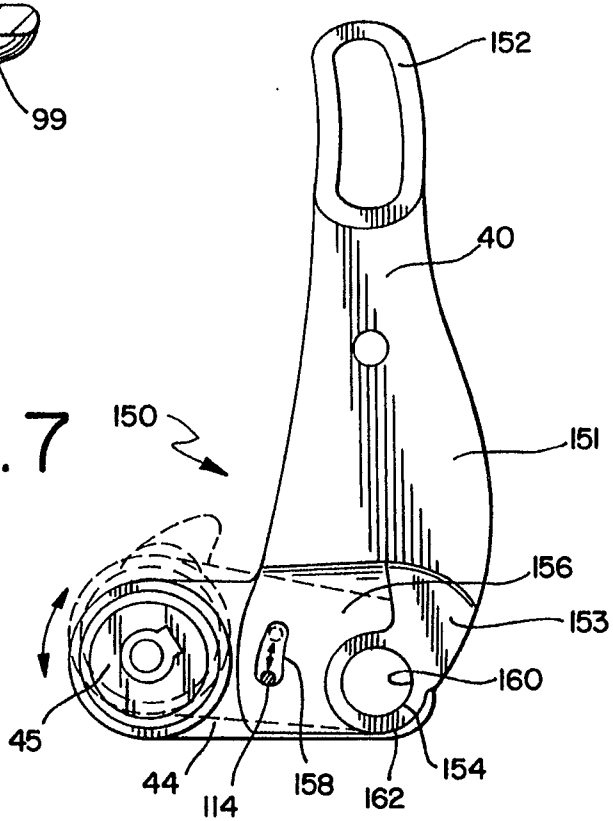
FIG. 7 is a side elevational view of the present shift handle and start button bracket assembly.

Referring now to FIGS. 2 and 7, the shift handle 40 is shown coupled to the start button bracket 44 and thus forms an assembly 150. The shift handle 40 includes a body portion 151 including an upper end with a handle formation 152 and a lower end with an attachment formation 153. The attachment formation 153 is further equipped with a pivot boss 154 and a lug 156 having an elongated slot 158. In addition, a throughbore 160 is provided in the boss 154 to attach the shift handle 40 to the boss 120 of the steering bracket 88.

On the start button bracket 44, the fastener 114 is inserted through the slot 158 to be slidably positionable between a lower position shown in solid lines, and an upper position, shown in phantom. Likewise, the bracket 44 includes a pivot opening 162 (best seen in FIG. 2) dimensioned to pivotally engage the pivot boss 154 on a port side of the handle 40, so that the start button bracket 44 also pivots between the upper and lower positions of the fastener 114 in the slot 158. Opposite the pivot opening 162 is the start button 45.

This pivotable relationship between the start button bracket 44 and the shift handle body portion 150 enables the assembler of the present motor to ensure that the start button 45 will be in alignment with the switch contact 108*a* of the automatic starter switch 108 only when the shift handle 40 is in the neutral gear position. Thus, the start button 45 may trigger the switch 108 only when the motor is in neutral. The adjustability of the start button bracket 44 relative to the shift handle 40 provides the assembler with the capability to accommodate for variations in individual motors without making extensive adjustments to the shift linkage of the motor 10. Once the proper alignment between the shift handle 40 and the start button bracket 44, the fastener 114 is tightened, and remains in that position unless maintenance is required.

A significant feature of the present steering assembly, is that without having to remove the tiller arm 68, the user can easily switch from manual steering to remote steering. The user can subsequently remove the remote steering mechanism and return back to the manual steering system using the tiller arm 68, by removing the retaining fastener 129 and returning the tiller arm back to the horizontal position.

Furthermore, because of the inclusion of the present starter switch recess 106, the starter switch mechanism 108 is conveniently located on the steering bracket 88 without being exposed. The fact that the starter switch mechanism 108 is recessed and secured onto the steering bracket 88, and the electrical leads 109 and 110 are drawn down through the channel 112 of the steering bracket 88 and to the engine 18, the wiring of the starter switch mechanism 108 is less likely to be damaged by the user or worn through chaffing over an extended period of use.

While a particular embodiment of the present tiller arm and steering bracket assembly for an outboard motor has been shown and described, it will be appreciated by those skilled in the art that changes and modifications may be made thereto without departing from the invention in its broader aspects and as set forth in the following claims.

What is claimed is:

1. A tiller arm and steering bracket assembly for an outboard motor having an engine, said assembly comprising:

a steering bracket having a head portion with an outwardly projecting tongue portion;

remote steering attachment means on said tongue portion for selectively attaching thereto a remote steering mechanism;

a tiller arm having a first end configured with means for pivotally coupling said tiller arm to said head portion of said steering bracket, said tiller arm being positionable in one of an operative position, with said tiller arm pivoted downwards to rest upon said tongue portion in a generally horizontal position providing for manual steering of the outboard motor, and an inoperative position, with said tiller arm pivoted upwards in a generally vertical position providing for said remote steering attachment means to be utilized; and retaining means for retaining said tiller arm in said inoperative position.

2. The assembly as defined in claim 1, wherein said remote steering attachment means includes a throughbore which extends through said tongue portion.

3. The assembly as defined in claim 1, wherein said tiller handle includes an underside having at least one interference rib depending therefrom, said at least one interference rib configured and arranged to contact said tongue portion of said steering bracket and to support said tiller handle on said tongue portion when said tiller handle is placed in said operative position.

4. The assembly as defined in claim 3, wherein said at least one interference rib includes at least one retaining ledge disposed closest to said first end of said tiller handle, said at least one retaining ledge supports said tiller handle on said head portion of said steering bracket in an upright position substantially perpendicular to said steering bracket.

5. The assembly as defined in claim 4, wherein said head portion includes at least one integral crest formation configured and arranged to contact said at least one retaining ledge to provide additional support to said tiller handle when placed in said upright position.

6. The assembly as defined in claim 1, wherein said retaining means is a bore formed through said steering bracket, said bore being positioned proximate said head portion such that when said tiller handle is placed in said inoperative position, a retaining pin may be introduced into said bore so that said retaining pin contacts said tiller handle at a point which prevents said tiller handle from unintentionally returning to said operative position.

7. The assembly as defined in claim 1, wherein said steering bracket includes a recess which is in direct communication with a channel formed through said steering bracket for accepting and mounting thereto a starter means for electronically starting the engine, said recess and said channel being configured to protect said starter means from accidental breakage and interference with the operability of said steering bracket and said tiller handle.

8. A tiller arm and steering bracket assembly for an outboard motor having an engine, said assembly comprising:

a steering bracket having a head portion with an outwardly projecting tongue portion;

a tiller arm having a first end configured with means for pivotally coupling said tiller arm to said head portion of said steering bracket, said tiller arm being selectively positionable in one of an operative position and an inoperative position, said tiller arm including at least one interference formation configured and arranged to contact said tongue portion of said steering bracket and to support said tiller arm on said tongue portion when said tiller arm is placed in said operative position;

said steering bracket includes a recess which is in direct communication with a channel formed through said steering bracket for accepting and mounting thereto a starter means for electronically starting the engine, said recess and said channel being configured to protect said starter means from accidental breakage and interference with the operability of said steering bracket and said tiller arm.

9. The assembly as defined in claim 8 further including remote steering attachment means on said tongue portion for selectively attaching thereto a remote steering mechanism.

10. The assembly as defined in claim 8, wherein said at least one interference rib includes at least one retaining ledge disposed closest to said first end of said tiller handle, said at least one retaining ledge supports said tiller handle on said head portion of said steering bracket in an upright position substantially perpendicular to said steering bracket.

11. The assembly as defined in claim 10, wherein said head portion includes at least one integral crest formation configured and arranged to contact said at least one retaining ledge to provide additional support to said tiller handle when placed in said upright position.

12. The assembly as defined in claim 8, including retaining means for retaining said tiller handle in said inoperative position.

13. The assembly as defined in claim 12, wherein said retaining means is a bore formed through said steering bracket, said bore being positioned proximate said head portion such that when said tiller handle is placed in said inoperative position, a retaining pin may be introduced into said bore so that said retaining pin contacts said tiller handle at a point which prevents said tiller handle from unintentionally returning to said operative position.

14. A tiller arm and steering assembly for an outboard motor having an engine, said assembly comprising:

a steering bracket having a head portion with an outwardly projecting tongue portion;

a tiller handle having a first end configured with means for pivotally coupling said tiller handle to said head portion of said steering bracket and a second end opposite said first end, said tiller handle being selectively positionable in one of a generally horizontal position and a generally vertical position, said tiller handle including an underside having at least one interference rib depending therefrom;

said at least one interference rib configured and arranged to contact said tongue portion of said steering bracket and to support said tiller handle on said tongue portion when said tiller handle is placed in said generally horizontal position;

said at least one interference rib including at least one retaining ledge disposed closest to said first end of said tiller handle, said at least one retaining ledge supports said tiller handle on said head portion of said steering bracket in an upright position substantially perpendicular to said steering bracket when said tiller handle is placed in said generally vertical position;

remote steering attachment means on said tongue portion for attaching thereto a remote steering mechanism when said tiller handle is in said generally vertical position; and retaining means for retaining said tiller handle in said vertical position.

15. The assembly as defined in claim 14, wherein said head portion includes at least one integral crest formation configured and arranged to contact said at least one retaining ledge to provide additional support to said tiller handle when placed in said upright position.

16. A shift handle and start button bracket assembly for use in a steering assembly of an outboard marine motor having a start mechanism, the steering assembly including a steering bracket having a starter control device attached thereto, said shift handle and start button assembly comprising:

a shift handle having a body portion provided with an attachment formation for operably connecting said shift handle to the steering bracket; and a start button bracket having connecting means for operably connecting said start button bracket to said shift handle so that said start button bracket is pivotally positionable with respect to said body portion of said shift handle, and a start button mechanism opposite said connecting means, said start button mechanism configured to be operationally coupled to the start mechanism when said shift handle is attached to the steering bracket and said shift handle is in the neutral gear position.

17. The shift handle and start button bracket as defined in claim 16 wherein said attachment formation of said shift handle contains a pivot boss having a throughbore, said throughbore being configured to accept a fastener for attaching said shift handle to the steering bracket.

18. The shift handle and start button bracket as defined in claim 17 wherein said connecting means of said start button bracket contains a pivot opening dimensioned to pivotally connect said start button bracket to said shift handle.

19. The shift handle and start button bracket as defined in claim 18 wherein said attachment formation of said shift handle is further equipped with a lug having an elongated slot, and said start button bracket contains a bore positioned for insertion of an adjustment fastener through said slot and into said bore, so that said start button bracket is slidably positionable with respect to said shift handle, and said adjustment fastener can be tightened to secure said start button bracket's position with respect to said shift handle.

* * * * *